United States Patent [19]

Shibata

[11] Patent Number: 4,938,159

[45] Date of Patent: Jul. 3, 1990

[54] THREAD DETECTING APPARATUS IN A SEWING MACHINE

[75] Inventor: Yoshio Shibata, Aichi, Japan

[73] Assignee: Kabushikikaisha Barudan, Aichi, Japan

[21] Appl. No.: 321,127

[22] Filed: Mar. 9, 1989

[30] Foreign Application Priority Data

Apr. 27, 1988 [JP] Japan ..... 63-105173

[51] Int. Cl.[5] ..... D05B 69/36

[52] U.S. Cl. ..... 112/273; 112/278

[58] Field of Search ..... 112/273, 278, 80.18; 242/37 R; 139/353; 66/163; 324/454

[56] References Cited

U.S. PATENT DOCUMENTS 4,256,247 3/1981 Loepfe ..... 242/37 R X
4,426,948 1/1984 Olasz et al. ..... 112/273
4,429,651 2/1984 Tajima ..... 112/273
4,628,847 12/1986 Rydborn ..... 112/273
4,763,588 8/1988 Rydborn ..... 112/273

*Primary Examiner*—Peter Nerbun
*Attorney, Agent, or Firm*—Pollock, Vande Sande & Priddy

[57] ABSTRACT

A detecting electrode is mounted on the path of a thread in a sewing machine. When a cloth is sewn in the sewing machine, a bobbin thread or a needle thread moves spatially against the detecting electrode. An electric signal is obtained on the detecting electrode in response to such movement of the thread. On the other hand, a timing signal generator generates a timing signal synchronous with the vertical movement of the needle in the sewing machine. A discriminator receives the electrical signal from the detecting electrode and the timing signal from the timing signal generator. The discriminator compares the electric signal with a reference signal when it receives the timing signal and outputs a discrimination signal in accordance with the result of the comparison.

4 Claims, 7 Drawing Sheets

THREAD DETECTING APPARATUS IN A SEWING MACHINE

BACKGROUND OF THE INVENTION

1. Field of the Invention

This invention relates to a thread detecting apparatus in a sewing machine which is adapted to detect the break or exhaustion of a thread for sewing.

2. Description of the Prior Art

The conventional thread detecting apparatus includes a piezoelectric element made to contact mechanically with a thread passing through the needle hole of a throat plate. When the thread is still retained in a sewing work, the piezoelectric element, being rubbed upon by the the thread, generates an electric signal. On the other hand, when the thread is exhausted, the rubbing movement of the thread disappears and the piezoelectric element stops generating the electrical signal. The presence of the thread can be detected from the presence of this electrical signal. As such an apparatus, there is one which is disclosed, for example, in U.S. Pat. No. 4,429,651.

In the above mentioned apparatus, the thread is napped or injured on its surface and easily snaps off since the thread rubs upon the piezoelectric element.

In order to eliminate the above mentioned problem, it is possible to put a photoelectric element on an optical path used up intercepted by the thread and to know the presence of the thread by detecting if the thread intercepts the optical path or not.

According to this idea, however, the dust which is generated from threads and cloths in sewing work may often stay in the optical path and intercept the light through the path. Thus, the presence of the thread is detected by mistake even though the thread is really absent.

SUMMARY OF THE INVENTION

An object of the present invention is to provide a thread detecting apparatus which is adapted to detect immediately the absence of the thread when it breaks or is used up in the sewing work. As a result of this detection, it is possible to try to prevent a more serious sewing fault on the cloth or to demand the supply of the thread.

Another object of the present invention is to provide a thread detecting apparatus which is adapted to detect the presence of the thread without imposing mechanical load on the thread.

In the present invention, an electric signal is obtained on a detecting electrode as the result of the spatial movement of the thread against the electrode when the thread is present. On the other hand, such electric signal is not obtained when the thread is absent. The presence of the thread is determined according to if the electric signal is generated or not. Consequently, the presence of the thread can be found without making the electrode contact with the thread. The presence of the thread can be detected without imposing any mechanical load on the thread for the detection of it.

Still another object of the present invention is to provide a thread detecting apparatus wherein the presence of the thread can be accurately known even though much dust is generated from threads or cloths in the sewing work.

In the present invention, the electric signal is obtained on the detecting electrode when the thread moves actively against the electrode. On the other hand, the dust is substantially stationary even if it attaches to the detecting electrode. Accordingly, the electric signal is not generated on the detecting electrode by the dust. Thus, a clear signal is obtained on the detecting electrode in accordance with the presence of the thread and it can be accurately detected.

Other objects and advantages of the invention will become apparent during the following discussion of the accompanying drawings.

DESCRIPTION OF THE PREFERRED EMBODIMENT

Figure 1:
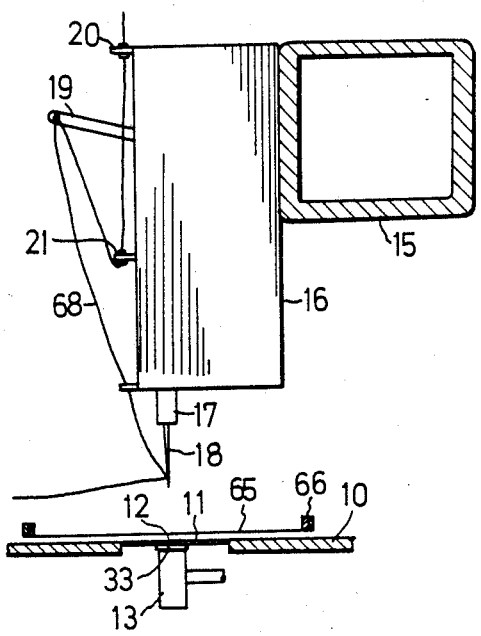
FIG. 1 is a side elevation in partial section of a sewing machine.

In FIG. 1 is shown the outline of the construction of a sewing machine. A bed 10 in the sewing machine is provided with a throat plate 11 formed with a needle hole 12. A rotary hook assembly 13 is mounted beneath the throat plate 11. Over the throat plate 11, on the other hand, is arranged a head 16 mounted on a frame 15. The head 16 is provided with a needle bar 17 for vertical movement and a needle 18 is attached to the lower end of the needle bar 17. The head is provided as well with a thread take-up lever 19, a thread guide 20 and so on.

The construction of the above mentioned rotary hook assembly 13 is well known and the outline of the construction is shown in FIGS. 7 through 10. The rotary hook assembly 13 consists of a rotary hook 23 and a bobbin case holder 24 disposed inside the hook 23. The rotary hook 23 is rotatably mounted on a hook drive shaft 25 in the well known manner. The rotary hook 23 is provided, on the circumference thereof, with a hook point 26 and a thread guard 27. On the other hand, the bobbin case holder 24 is prevented from rotating by a hook supporting plate 28. A bobbin case 29 is provided inside the bobbin case holder 24 and a bobbin with a bobbin thread wound thereon is contained inside the bobbin case 29. A numeral 30 represents a thread guide provided on the bobbin case 29.

Figure 4:
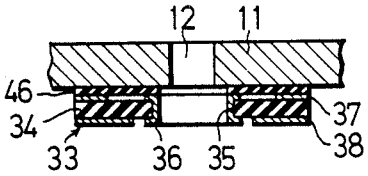
FIG. 4 is an enlarged section taken along the line IV—IV of FIG. 2.
Figure 2:
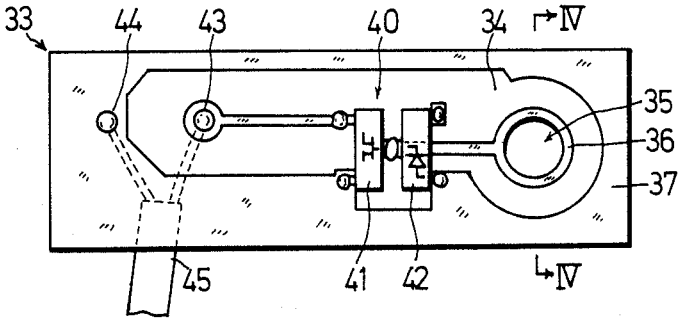
FIG. 2 is a plane view of a sensor.
Figure 3:
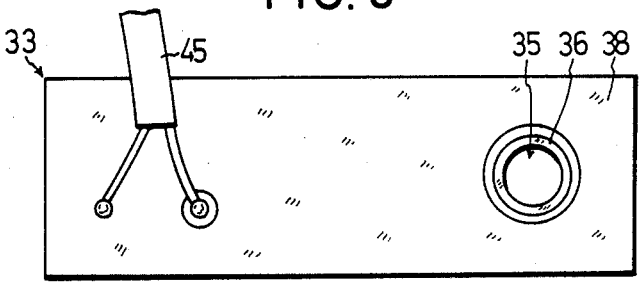
FIG. 3 is a bottom view of the sensor.

In the next place, a thread-break shut-down device provided on the sewing machine is explained. A sensor 33 in the thread-break shut-down device is mounted beneath the throat plate 11 as shown in FIG. 1. The detail of the mounting of the sensor is shown in FIG. 4 and the plane view and the bottom view of the sensor 33 are shown in FIGS. 2 and 3, respectively. The sensor 33 includes an insulating basal plate 34 formed with a through hole 35. Around the through hole 35 is mounted a detecting electrode 36 of an annular form. The electrode 36 consists of copper foils which are stuck to both sides of the insulating basal plate 34 so as to surround the circumference of the through hole 35 and of a cylindrical metal (with the surface thereof solder-plated) which connects the copper foils and is adapted on the inner surface of the through hole 35. The detecting electrode 36 is shaped in a completely circular toroidal form in the present embodiment but it may be in a rectangular form or an open C-shaped form. Shielding electrodes 37 and 38 surrounding the detecting electrode 36 are provided on one side and the other side of the insulating basal plate 34, respectively. These electrodes 37 and 38 are made of copper foils stuck on both surfaces of the basal plate 34. On one surface of the insulating basal plate 34 is mounted a preamplifier 40 with a high input impedance. The preamplifier 40 consists of an FET 41 and a protective diode 42 therefor. Output terminals 43 and 44 are provided on one side of the basal plate 34 and one end of lead wires 45, such as a shield wire which is passed through the basal plate 34 from the other side thereof, are connected to the output terminals. The other ends of the lead wires 45 are connected to a main amplifier in a discriminating means to be mentioned hereinafter.

The sensor 33 of the above mentioned construction is fastened against the metallic throat plate 11 via an insulating layer 46 by a joining means, with the through hole 35 overlapping the needle hole 12, as shown in FIG. 4. The joining means may be screws, adhesives or other well known means. As the insulating layer, a thin insulating plate or an insulating paint coating is used. Furthermore, the sensor 33 may be embedded in a depression formed on the lower surface of the needle plate 11.

Figure 5:
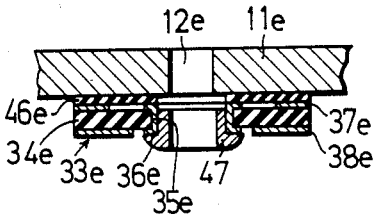
FIG. 5 is a section similar to FIG. 4, showing a different example of the sensor.

As shown in FIG. 5, a sensor 33*e* may include a toroidal insulator 47 disposed inside a detecting electrode 36*e*. This insulator prevents the wear of the detecting electrode 36*e* due to the thread. Those members in the sensor 33*e* in FIG. 5 which are considered to be the same as or equivalent in construction to the members in FIG. 4 are given numerals the same as those in FIG. 4 but with a subscript "e" and the explanation of the members is not repeated.

Figure 6:
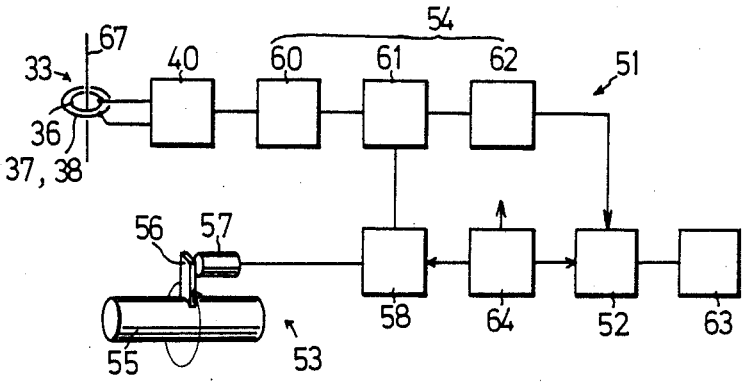
FIG. 6 is a block diagram of a thread-break shut-down device.

In the next place, the construction of the thread-break shut-down device is shown in the form of a block diagram in FIG. 6. This device includes a thread detecting means 51 for the detection of the break or end of the thread, and a shut-down means 52 for receiving a signal from the thread detecting means 51 to stop the operation of the sewing machine. The thread detecting means 51 includes the aforementioned sensor 33, a timing signal generating means 53 and a discriminating means 54.

The timing signal generating means 53 comprises a detection member mounted on a main drive shaft 55 of the sewing machine. A metallic piece 56, a proximity sensor 57 utilizing electrostatic capacity or magnetism and a gate signal forming circuit 58 may comprise the timing signal generating means 53. In the timing signal generating means 53 of this type, a detected signal is initiated by the proximity sensor 57 every time the detection member 56 is rotated to a position objacent the proximity sensor 57 and the gate signal forming circuit 58 outputs a pulse shapee gate signal as a timing signal.

The discriminating means 54 is provided with a main amplifying circuit 60, a gate circuit 61 and a comparator circuit 62. The signal from the sensor 33 is amplified in the main amplifier circuit 60 and is sent to the gate circuit 61. The gate circuit 61 is adapted to pass an output signal from the main amplifier circuit 60 only when the gate circuit 61 receives the signal from the gate signal forming circuit 58. The output signal is compared with a reference value set in beforehand in the comparator circuit 62, which outputs a signal in accordance with the result of the comparison. For example, when the signal from the gate circuit 61 is greater than the reference value, the comparator circuit 62 outputs a thread-presence signal, for example, a signal "0", and when the signal is less than the reference value, the comparator circuit 62 outputs a thread-absence signal, for example, a signal "1".

The shut-down means 52 receives the thread-absence signal from the comparator circuit 62 and stops the electric motor driving the main drive shaft of the sewing machine. An indicator 63 such as a lamp or a buzzer for indicating that the shut-down operation has been done is connected to the shut-down means 52.

A power supply circuit 64 is provided for supplying the electric power for the operation of each of the above circuits.

The sewing of cloth with use of the above mentioned sewing machine is as follows. A cloth 65 to be sewn is spread on a cloth driving frame 66. The frame 66 is moved in a horizontal plane by a well known driving means and the cloth 65 is moved along the upper surface of the bed 10. Some times the cloth may be manually moved. When the main drive shaft 55 of the sewing machine is rotated by the electric motor, the hook drive shaft 25 linked to the main drive shaft is rotated and the rotary hook 23 is rotated as well. As the result of the rotation of these members, the needle bar 17 and thread take-up lever 19 move up and down. By the movement of these members, the cloth 65 is sewn, as in the well known manner, with a bobbin thread 67 fed from the bobbin in the rotary hook assembly 13 and with a needle thread 68 fed through a needle hole of the needle 18. The relationship between the rotation angle of the main drive shaft 55 and the operation of the thread take-up lever 19, the needle 18 and the rotary hook 23 is such as shown in FIGS. 11*a*. through 11*c*. for example.

Figure 7:
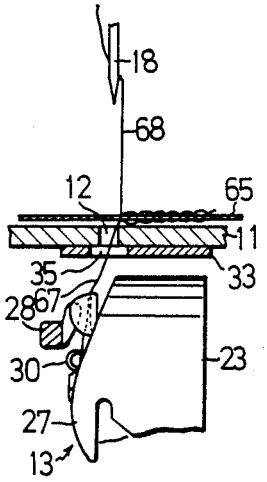
FIG. 7 is a view showing the relationship between a bobbin thread and a rotary hook assembly at a time during a sewing work.
Figure 9:
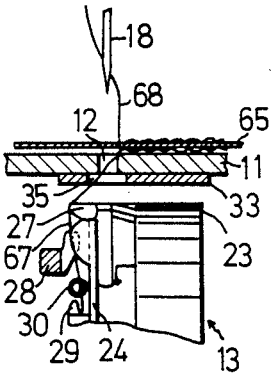
FIG. 9 is a view showing the relationship between the bobbin thread and the rotary hook assembly at a time different from that of FIG. 7.
Figure 8:
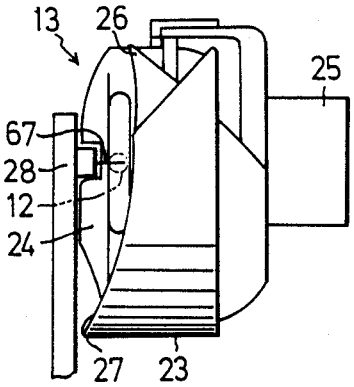
FIG. 8 is a plane view of the rotary hook assembly in the state of FIG. 7.
Figure 10:
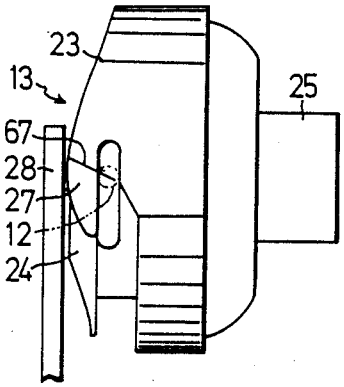
FIG. 10 is a plane view of the rotary hook assembly in the state of FIG. 9.

When the sewing work is carried out in the above mentioned manner, the operation of the thread-break shut-down device is as follows. When both needle thread 68 and bobbin thread 67 are normally fed and the sewing work is satisfactorily done, the bobbin thread 67 and the needle thread 68 move through the detecting electrode 36 in the sensor 33. The bobbin thread 67 is swung transversely as well by the thread guard 27 in accordance with the rotation of the rotary hook 23 as shown in FIGS. 7 and 8 and in FIGS. 9 and 10. Namely, the bobbin thread 67 and the needle thread 68 move spatially in the through hole 35 against the detecting electrode 36. The needle thread 68 and the bobbin thread 67 are slightly electrically charges for example. When such needle thread 68 or bobbin thread 67 moves in the detecting electrode 36, an electric signal is induced on the detecting electrode 36 in accordance with the movement of the threads. The induced signal is amplified in the preamplifier circuit 40 and the main amplifier circuit 60 and arrives at the gate circuit 61. The signal is shown as a trace d. in FIG. 11, for example.

On the other hand, the timing signal generating means 53 outputs a timing signal (gate signal) from the gate signal forming circuit 58 thereof towards the gate circuit 61 synchronously with the vertical movement of the needle 18 and the rotation of the rotary hook 23. The phase when the timing signal is uttered corresponds to the interval 58°~110° of the rotation angle of the main drive shaft 55 as shown by the trace e. in FIG. 11. This interval 58°~110° corresponds to the phase when only the bobbin thread 67 is present in the detecting electrode 36 and is besides swung transversely by the thread guard 27.

Figure 11:
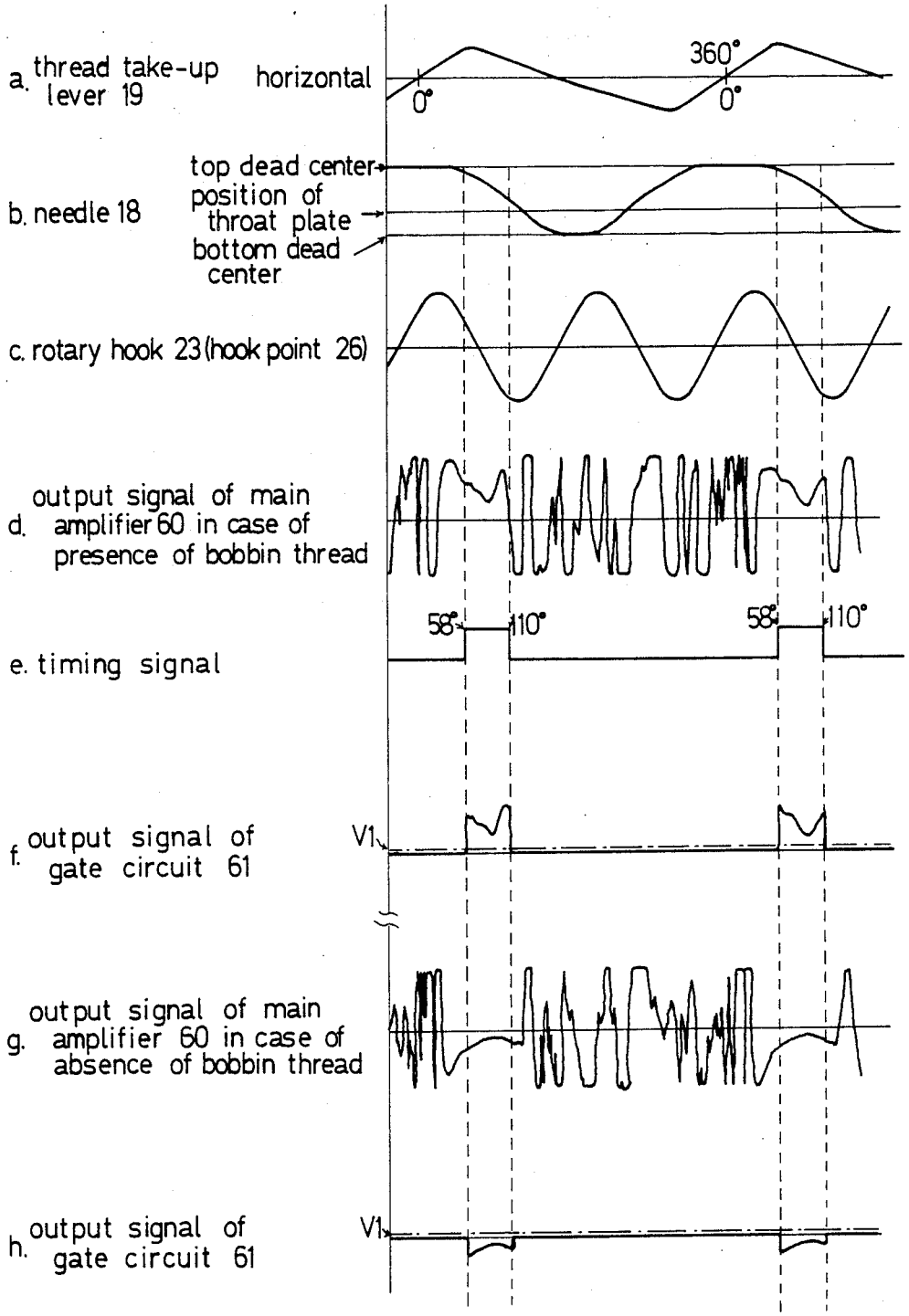
FIG. 11 is a time chart showing the relationship between the operation of a thread take-up lever, a needle and the rotary hook assembly in the sewing machine and various signal wave forms.

The gate circuit 61 receives the aforementioned signals and outputs a signal as shown by the trace f. in FIG. 11 towards the comparator circuit 62. The comparator circuit 62 compares the level of the signal from the gate circuit 61 during the above mentioned phase of the timing signal with the reference value V1, for example, +10 mV. In the case of the signal shown by the trace f. in FIG. 11, the level of the signal from the gate circuit 61 surpasses the above mentioned reference value and so the comparator circuit 62 outputs the thread-presence signal "0". Consequently, the operation of the shut-down means 52 does not take place.

On the other hand, when the bobbin thread 67 is not normally fed on account of the break or when used up, the signal sent to the gate circuit 61 form the main amplifier circuit 60 is changed to one represented by the trace g. in FIG. 11 and the signal sent to the comparator circuit 62 from the gate circuit 61 is changed to one represented by the trace h. in FIG. 11. The signal of the trace h. is less than the aforementioned reference value V1 as is clear from the figure and hence the comparator circuit 62 provides the thread-absence signal "1" to the shut-down means 52. The shut-down means 52 receives the signal to stop the electric motor driving the main drive shaft 55 and the operation of the sewing machine is stopped. The indicator 63 is turned to the indication state.

It is desirable to make the phase of the timing signal generating means 53 timing signal coincide with the time when the difference due to the presence or absence of the bobbin thread 67 appears most clearly in the signal obtained on the detecting electrode 36. It is preferable to obtain experimentally such phase since it is different from sewing machine to sewing machine.

Figure 12:
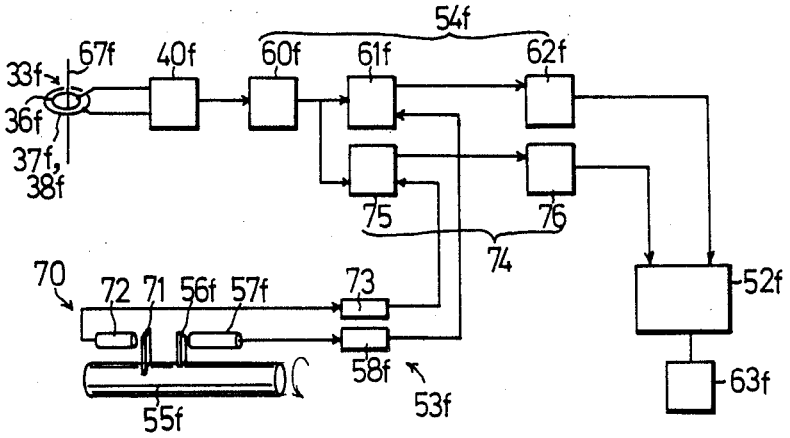
FIG. 12 is a block diagram of a second embodiment of the thread-break shut-down device according to the present invention.

In the next place, FIGS. 12 through 16 show an embodiment wherein not only the detection of the bobbin thread but also that of the needle thread can be simultaneously carried out. In this embodiment, a timing signal generating means 70 and a discriminating means 74 for the needle thread are provided besides a timing signal generating means **53*f* and a discriminating means 54*f* for the bobbin thread, as shown in FIG. 12. The timing signal generating means 70 for the needle thread consists of a detection member 71, a proximity sensor 72 and a gate signal forming circuit 73 similarly as the means 53*f* for the bobbin thread. The discriminating means 74 for the needle thread includes a gate circuit 75 and a comparator circuit 76 similarly as the means 54*f*** for the bobbin thread.

Figure 13:
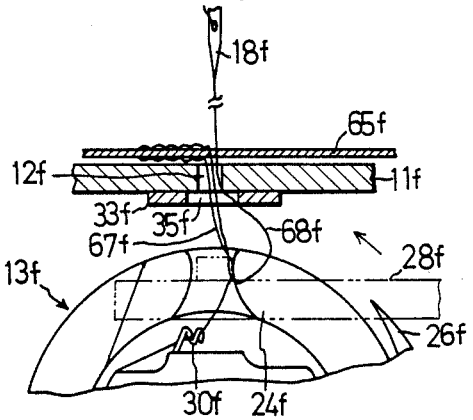
FIGS. 13, 14 and 15 are views showing relationships between the sensor and the thread at times different from one another.
Figure 14:
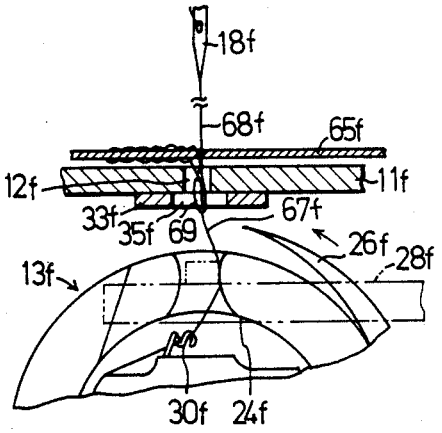
Figure 15:
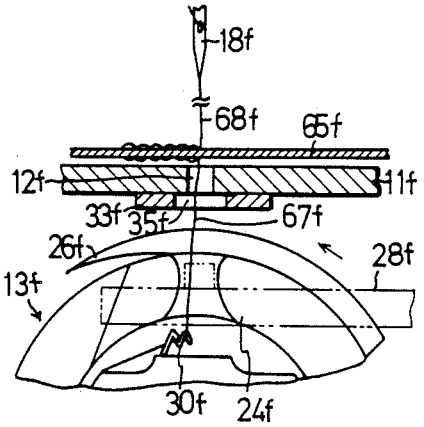

The detection of the needle and bobbing threads in the present embodiment is carried out as follows. The timing signal generating means 70 outputs the timing signal as shown by the trace b. in FIG. 16 during the phase when the rotation angle of the main drive shaft lies in the interval 0°~45°. When the angle is 0°, the relationship among the sensor **33*f*, a bobbin thread 67*f* and a needle thread 68*f* is as shown in FIG. 13, and when the angle is 45°, the relationship is as shown in FIG. 15. FIG. 14 shows the situation transient from the situation of FIG. 13 to that of FIG. 15. In the process where the rotation angle of the main drive shaft varies from 0° to 45°, the needle thread 68*f* gets out from a bobbin case holder 24*f* as shown in FIG. 13, a loop 69 of the needle thread 68*f* becomes smaller in addition as shown in FIG. 14 and the needle thread 68*f* gets out completely from a through hole 35*f* of a sensor 33*f*. Namely, the needle thread 68*f* moves most widely in the through hole 35*f* of the sensor 33*f*** within the above mentioned process.

Figure 16:
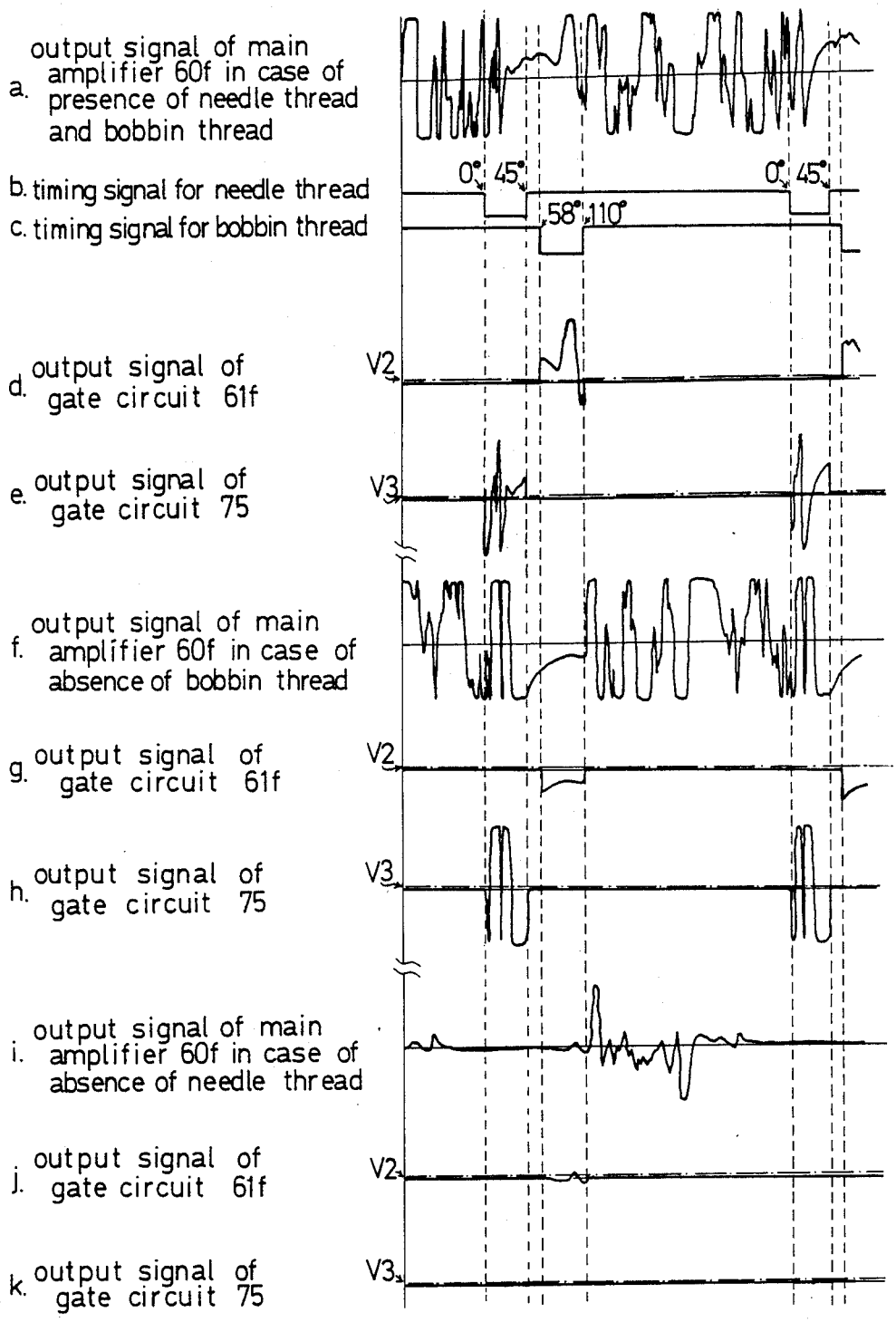
FIG. 16 is a view showing various signal wave forms in the second embodiment.
Figure 17:
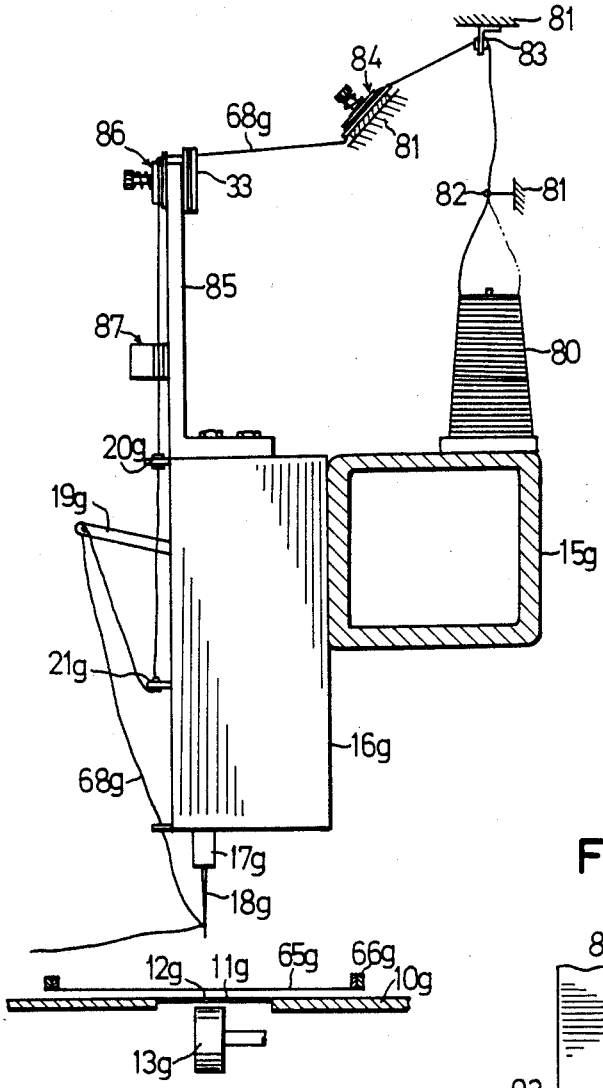
FIG. 17 is a side elevation in partial section of a sewing machine wherein a third embodiment of the present invention is embodied.

When both the needle thread **68*f* and the bobbin thread 67*f* are normally fed, a main amplifier circuit 60*f* outputs a signal as shown by the trace a. of FIG. 16. Consequently, gate circuits 61*f* and 75 output signals shown by the traces d. and e. of FIG. 16, respectively, Since these signals exceed the reference values V2 and V3 of the respective comparator circuits 62*f* and 76, respectively, the outputs of the comparator circuits 62*f* and 76** indicate both the thread-presence signals.

If only the bobbin thread **67*f* breaks or is exhausted and the feed of the thread is stopped, the output signal of the main amplifier circuit 60*f* becomes the signal as shown by the trace f. of FIG. 16. Consequently, the output signals of the gate circuits 61*f* and 75 become those as shown by traces g. and h. of FIG. 16. Since the output signal of the gate circuit 61*f* is less than the reference value V2 of the comparator circuit 62*f*, it outputs the thread-absence signal. A shut-down means 52*f*** receives this signal to stop the operation of the sewing machine.

If only the needle thread **68*f* breaks or runs out and the feed of the thread is stopped, the output signal of the main amplifier circuit 60*f* becomes the signal as shown by the trace i. of FIG. 16. Consequently, the output signals of the gate circuits 61*f* and 75 become those as shown by traces j. and k. of FIG. 16. Since the output signal of the gate circuit 75 is less than the reference value V3 of the comparator circuit 76, it outputs the thread-absence signal. The shut-down means 52*f*** receives this signal to stop the operation of the sewing machine.

Those members in the above embodiment which are considered to be the same in operation as or equivalent in construction to those in the previous embodiments are given the numerals same as those in the previous embodiments but with the subscript "f" and the explanation of the members is not repeated. (Furthermore, in the following embodiment, numerals with the subscript "g" are used according to the same idea and the explanation of the members is not repeated.)

In the next place, FIGS. 17 through 20 show an embodiment wherein the presence of the bobbin thread can be detected by using the needle thread. In reference to FIG. 17, a spool 80 for a needle thread 68g is mounted on a frame 15g. The needle thread 68g is fed from this spool 80 through thread guides 82, 83 and a thread tension adjustment means 84 each mounted on a frame 81 formed integrally with the frame 15g and through thread tension adjustment means 86 and 87 each provided on a support 85 attached on a head 16g.

Figure 18:
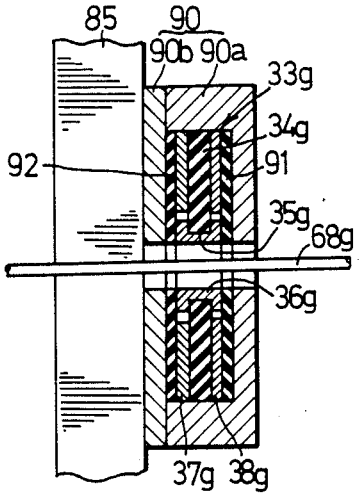
FIG. 18 is a horizontal section showing the situation of the needle thread passed through the sensor of FIG. 17.
Figure 19:
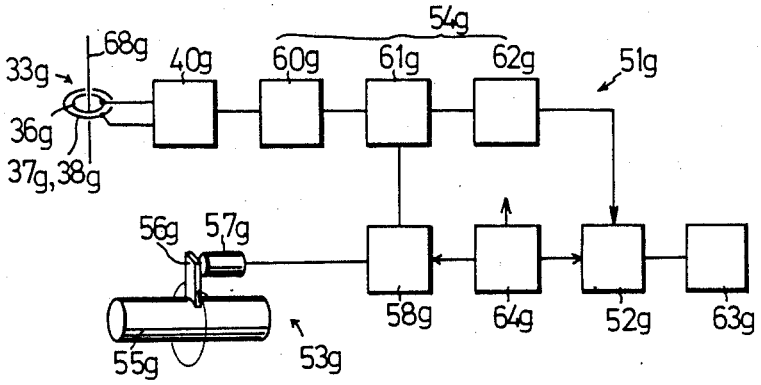
FIG. 19 is a block diagram of a thread-break shut-down device in the third embodiment and FIG. 20 is a view showing various signal wave forms in the third embodiment.
Figure 20:
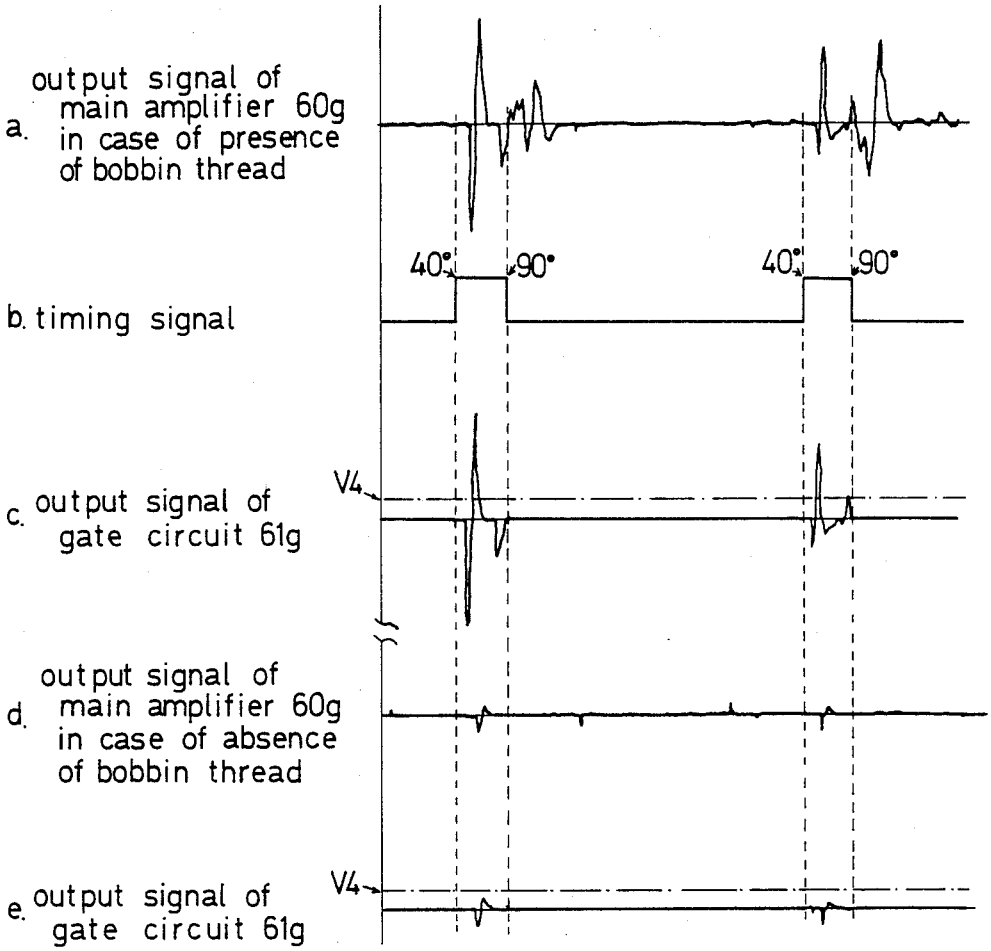

A sensor 33g of the thread detecting apparatus is mounted on the support 85 and the needle thread strained between the thread tension adjustment means 84 and 86 is passed through the sensor. The situation is shown in FIG. 18. The strained needle thread 68g only advances intermittently through a detecting electrode 36g of the sensor 33g but does not swing laterally in the sewing work. The sensor 33g is disposed inside a shield case 90 consisting of a main member 90a and a lid 90b and is electrically insulated by insulation plates 91 and 92.

The presence of the bobbin thread is detected in the sewing work as follows. When the bobbin thread and the needle thread 68g are normally fed, a main amplifier circuit 60g output a signal as shown by the trace a. of FIG. 20. Since the needle thread 68g advances intermittently in accordance with the vertical movement of a thread take-up lever 19g, the amplitude of the output signal is increased every time when the thread advances. A timing signal generating means 53g outputs a timing signal in the phase when the amplitude of the output signal increases, as shown by the trace b. of FIG. 20. The phase corresponds, for example, to the interval 40°~90° of the rotation angle of the main drive shaft 55g. This interval, is proper to each of various sewing machines. Wen the output signal of the main amplifier circuit 60g is such as mentioned above, the output signal of a gate circuit 61g is a signal as shown by the trace c. of FIG. 20. Since this signal exceeds the reference value V4 of a comparator circuit 62g, it outputs the thread-presence signal.

When the feed of the bobbin thread 67g is stopped on account of the break or it running out, the sewing work is not carried out satisfactorily. Then the needle thread 68g advances very slightly. Namely, the needle thread 68g advances only because the needle thread 68g linked with a cloth 65g is pulled out as the cloth 65g is transversely moved. When the cloth 65g is not transversely moved, the advance of the needle thread 68g disappears. The output signal of the main amplifier circuit 60g in this case is a signal as shown by the trace d. of FIG. 20. Consequently, the output signal of the gate circuit 61g becomes a signal as shown by the trace e. of FIG. 20. Since the level of this output signal is lower than the reference value V4 of the comparator circuit 62g, it outputs the thread-absence signal.

The detection of the presence of the bobbin thread utilizing the needle thread 68g in the above mentioned manner has the following advantages. The bobbin thread is feed out from the rotary hook assembly and is attached on the cloth by sewing after having advanced a very short feed path. On the other hand, the needle thread 68g is drawn out from the spool 80 and is then attached on the cloth 65g by sewing after having advanced a long feed path. Accordingly, the degree of the freedom for the place where the sensor 33g is mounted is high. Namely, the sensor may be mounted on an arbitrary part of the feed path of the needle thread 68g from the spool 80 to the needle 18g. It is preferably mounted on a portion where the fed needle thread is hard to swing transversely and it is desirable to select the portion in the interval between a thread guide 82 and a thread guide 20g.

In the above mentioned embodiment of the thread detecting apparatus, also when the needle thread 68g breaks or runs out, the movement of the needle thread against the sensor 33g, disappears as well. Thus, the output of the detecting electrode 36g disappears and an operation similar to that mentioned above is carried out. Namely, the break or exhaustion of the needle thread can be detected as well.

Furthermore, in the discriminating means 54g, the determination that the input signal to the comparator circuit 62g has become lower than the aforementioned reference value V4 may be done by directly receiving the signal from the main amplifier circuit 60g to the comparator circuit 62g without using the timing signal generating means 53g and the gate circuit 61g and by confirming that the signal is lower than the reference value for a time longer than a prescribed time (the time necessary for one sewing movement of the sewing machine, for example).

As many apparently widely different embodiments of the invention may be made without departing from the spirit and scope thereof, it is to be understood that the invention is not limited to the specific embodiments thereof except as defined in the appended claims.

I claim:

1. A thread detecting apparatus in a sewing machine for detecting the presence of a bobbin thread for sewing, said sewing machine including:

(1) a throat plate formed with a needle hole, (2) a rotary hook assembly mounted under said throat plate; and, (3) a needle mounted over said throat plate for vertical movement, comprising:

(a) a detecting electrode connected to said throat plate adjacent said needle hole adapted to generate an electric signal in accordance with the transverse spatial movement of a thread for sewing, passing through said needle hole in a direction towards said electrode by detecting an electric charge on said thread;

(b) a timing signal generating means adapted to generate a timing signal synchronously with the vertical movement of said needle, and (c) a discriminating means adapted to receive the electric signal from said detecting electrode and the timing signal from said timing signal generating means and to provide a discrimination signal when said electric signal exceeds a reference value when said discriminating means receives said timing signal.

2. A thread detecting apparatus in a sewing machine as set forth in claim 1 wherein said detecting electrode is provided around said needle hole.

3. A thread detecting apparatus in a sewing machine as set forth in claim 1 wherein said detecting electrode is provided in a feed path of a needle thread.

4. A thread detecting apparatus in a sewing machine as set forth in claim 2 wherein:

said timing signal generating means includes a timing signal generating means to generate a timing signal for detecting said needle thread, and a timing signal generating means to generate a timing signal for detecting said bobbin thread, and said discriminating means receives the electric signal from said detecting electrode and the timing signal for said needle thread from said timing signal generating means to provide a discrimination signal when said electric signal exceeds a reference value when said discriminating means receives said timing signal for said needle thread, and said discriminating means receiving the electric signal from said detecting electrode and the timing signal for said bobbin thread from said timing signal generating means, to provide a discrimination signal when said electric signal exceeds a reference value when said discriminating means for said bobbin thread receives said timing signal for said bobbin thread.

* * * * *